United States Patent [19]

Gentilcore et al.

[11] Patent Number: 5,052,451

[45] Date of Patent: Oct. 1, 1991

[54] DUST CONTROL APPARATUS

[75] Inventors: Michael J. Gentilcore, Maryland Heights, Mo.; David G. Mock, Yakima, Wash.

[73] Assignee: Mallinckrodt Specialty Chemicals Company, St. Louis, Mo.

[21] Appl. No.: 661,509

[22] Filed: Feb. 26, 1991

[51] Int. Cl.[5] ..... B65B 1/16

[52] U.S. Cl. ..... 141/67; 141/97; 141/286; 141/346; 141/372; 55/369; 55/374

[58] Field of Search ..... 55/369, 374–378; 141/67, 97, 251, 253, 286, 319, 346, 370, 372

[56] References Cited

U.S. PATENT DOCUMENTS

| | | | |
|---|---|---|---|
| 3,095,018 | 6/1963 | Moreland . | |
| 3,260,285 | 7/1966 | Vogt . | |
| 3,384,134 | 5/1968 | Hillerns . | |
| 3,428,098 | 2/1969 | Slay . | |
| 3,788,368 | 1/1974 | Geng et al. . | |
| 4,185,669 | 1/1980 | Jevakohoff | 141/286 X |
| 4,586,549 | 5/1986 | White . | |
| 4,685,598 | 8/1977 | Nezwovski | 141/286 X |
| 4,727,913 | 3/1988 | Bliss | 141/286 X |

*Primary Examiner*—Charles Hart

*Attorney, Agent, or Firm*—Haverstock, Garrett and Roberts

[57] ABSTRACT

A dust control apparatus having a cover member lowerable into an opening of a container, the cover member having a radially expandable seal for sealing the opening, the cover member having a passage therethrough adapted to receive a conduit, the cover member being operable in telescoping relation to the conduit and the passage being sufficiently larger than the conduit for the passage of air between the cover member and conduit, the cover member being movable laterally relative to the conduit to enable the cover member to be lowered into a container which is not precisely aligned therewith, a filter sleeve having a lower end attached to the cover member and an upper end attached to the conduit, the filter sleeve being adapted to prevent the escape of dust from the space between the cover member and conduit, the filter sleeve being protected by the conduit from damage caused by materials flowing through the conduit, the apparatus including an optional fume collecting annulus locatable in surrounding relation to the filter sleeve for collecting and exhausting gases and fumes collected thereby, and an optional inlet port for introducing inert gases or pressurized air to the apparatus.

20 Claims, 4 Drawing Sheets

DUST CONTROL APPARATUS

The present invention relates generally to dust control devices and more particularly to a device and system for effectively and economically controlling dust and other airborne materials which result from material handling operations involving products in the form of powders, pellets or other comminuted particles. The present dust control device is ideally suited for use in container filling operations and is easily attachable to a fill chute or other material delivery conduit and includes a cover member operable telescopically relative to the chute by pneumatic or other actuating means for engaging and sealing a drum or other container to be filled. The cover member includes a radially expandable seal which forms an airtight seal around the inside of the container opening such that air and other gases escaping from the conduit and container by the filling or other material handling operation are directed through filter means which separate airborne particulates therefrom. The present device is adaptable for covering and sealing a wide variety of containers, has a self centering capability and enables the container to be accurately weighed while the present device is engaged therewith. The present filter means are located so as to be protected from mechanical damage from flowing materials, are adaptable for filtering a wide variety of materials and particulate sizes and may optionally include fume collection means for removal of flammable and toxic gases, vapors and other airborne effluents. The present device may further optionally include an inlet port for such purposes as purging and cleaning the device.

BACKGROUND OF THE INVENTION

Numerous devices for controlling dust during container filling and other material handling operations involving pulverulent solids including a variety of means for sealing a container to be filled and for filtering airborne particulates from the flow of air created by the handling operation are well known in the art. Reference is made to U.S. Pat. No. 4,586,549 which discloses a device for vacuum filling of packages including a cylinder positionable in the opening of a package to be filled and a sealing plate located in surrounding relation to the cylinder having a gum rubber seal thereon which is movable using pneumatic cylinders into position to seal the package opening. Vacuum is used to draw material through the cylinder into the package with the vacuum flow being directed out of the package through mesh screens located on the bottom face of the cylinder. Such device suffers from numerous shortcomings and limitations, including that the pneumatic cylinder exerts a compressive force against the package to form a seal, making it difficult to accurately weigh the package when so engaged. Further, no means are disclosed for self centering the device relative to the package to be filled, and the mesh screens are exposed directly to the material flowing into the package making the screens susceptible to damage and other problems caused thereby. Reference is also made to U.S. Pat. No. 3,260,285 which discloses an apparatus for filling containers in which the container is sealed by a vertically movable support member which presses the container upwardly against an annular gasket and a saucer-shaped filter screen located inside the perimeter of the gasket filters airborne particulate from air and gases flowing upwardly therethrough. Such device suffers from the same limitations discussed above and includes a further shortcoming in that the movable support must be able to support and lift a full container to provide an airtight seal. Still another device for filling containers including filter means is shown in U.S. Pat. No. 3,095,018 which discloses a device having a vertically extendable fluid motor for raising a container into engagement with a downwardly facing sealing ring and a screen covering the opening to a vent located inside the perimeter of the sealing ring for filtering air flowing therethrough. Such device is also limited as discussed above. Contrasted to the relatively complicated devices disclosed in the above mentioned patents, the subject invention relates to a rather uncomplicated apparatus and system for controlling dust and fumes which result from material handling operations involving pulverulent and other dust generating materials.

SUMMARY OF THE INVENTION

The invention resides in the use of a device which operates to cover the open top of a drum or other container during solids handling operations and which acts to seal the opening of the container and filter particulate matter from the air which is displaced and escapes from the container and associated material handling devices during the handling operation. The present dust control device is well suited for use in industrial plants, warehouses and packaging facilities wherein it is desired to control nuisance and greater levels of dust without the requirement of complex air movement means such as ducts and blowers and dust collection means such as baghouses and the like. The present dust control device is especially well suited for use in solids loading and unloading operations wherein powdered, pelletized or other comminuted material is transferred between bulk storage means such as a bin or hopper and a smaller container such as a drum or "LEVERPAK" fiber container. The present dust control device is attachable to a chute or other material delivery device or conduit and includes a cover member or drum cover which is larger in diameter than the chute or other conduit and is operable telescopically relative thereto using pneumatic cylinders or other actuating means. The present device also includes radially expandable sealing means preferably comprising an inflatable seal which expands to form an airtight seal around the opening of a container and a filter sleeve to separate particulate matter from the air or other gases escaping from the container and chute. The present dust control device may be operated using pneumatic power or other means and may be automatically controlled by a plurality of valves. The present dust control device may optionally include fume collection means for use as required with flammable and toxic substances and also an inlet port usable for purging the system with inert gas and for other purposes.

In a typical container filling operation, a drum or other container to be filled is located beneath the drum cover which is in an elevated position normally referred to as the "up" or drum change position. The drum cover is then lowered by the actuating means from its up position into a "down" or drum filling position in engagement with the drum. The actuating means preferably comprise vertically operable pneumatic cylinders pivotably attached to the fill chute. The actuating or control rods which extend downwardly from the air cylinders are attached to the drum cover with flexible means such as wire cables. The pivotability of the air cylinders and flexibility of the wire cables provide a sufficient degree of lateral and transverse freedom of movement or alignment tolerance such that a drum to be engaged by the drum cover need not be perfectly and precisely aligned or centered with the dust control device. Such pivotability and flexibility also enable the drum cover to be lowered onto a severely misaligned or off center drum without causing damage to either the drum or the dust control device. Another feature of such attachment means is that after engagement between the drum cover and drum the actuating means continue to extend somewhat so as to place slack in the wire cables. This slack condition insures that the drum is not acted on by compressive forces so as to enable the drum to be easily weighed and to avoid damaging the drum.

The inflatable seal is filled with air or other suitable fluid after the drum cover is lowered into engagement with the drum. When inflated, the seal expands radially outwardly to form an airtight seal around the container opening which prevents dust from escaping between the drum cover and the inside diameter of the drum during the filling operation. The radial action of the inflatable seal is important, as it enables the drum to be sealed airtight without the requirement of hydraulic motors and other lifting means to raise the container and also because it provides self centering and alignment compensation capability to the present device. Also preferably, in conjunction with the inflatable seal, the bottom edge of the drum cover is rolled up or otherwise shaped to extend radially outwardly forming a lip therearound so as to provide protection for the inflatable seal when the drum cover is being engaged with a drum. The lip further provides some self centering capability and may act to maintain the lower edge of the inflated seal in proper position.

The filter sleeve having its lower end attached to the drum cover and its upper end attached to the fill chute acts to prevent the escape of dust from the annular space between the inside diameter of the drum cover and the outside diameter of the fill chute. Importantly, the filter sleeve is attached to the chute at a location sufficiently above the end of the chute such that the chute protects the filter from mechanical and other damage, clogging and other problems from the flowing material. The filter sleeve is preferably fabricated from a porous filter cloth or other suitable porous material enabling air, but not particulate, to pass therethrough. Also, the construction and operation of the filter sleeve is such that the sleeve is compacted when the drum cover is in its up or drum change position, and is extended when the drum cover is in its down or drum filling position. When in its extended position, the filter sleeve preferably provides sufficient surface area for filtering dust during the filling operation.

The optional fume collection annulus may be used to surround and enclose the filter sleeve to contain toxic and flammable fumes which pass through the filter sleeve. The fume collection annulus is attached to exhausting means for evacuating the fumes. The fume collection annulus includes a boot on the lower portion which enables the annulus to fully cover the filter sleeve in both the drum fill and change positions. The boot should be flexible or expandable as well as airtight for preventing the escape of gases and fumes between the hood and the drum cover. This boot may be made of a non-porous material such as nylon reinforced vinyl resin.

The optional inlet port may be located through the wall of the fill chute which may be used for purging the fill chute with inert gas to eliminate oxygen or other flammable or toxic gases from both the drum and the filling conduit, for increasing material flow rate and compacting material in the drum and for cleaning and flushing purposes.

The present device may be controlled using a variety of different systems. A preferred system controls the device with a single two position four-way valve which controls the introduction of compressed air to a plurality of other valves. When the four-way valve is placed in the down or drum-fill position, air is immediately and simultaneously supplied to the top side of each air cylinder. At the same time, the air located in the bottom portion of each cylinder is exhausted therefrom to lower the drum cover into its drum filling position. The inflation of the inflatable seal is delayed such that inflation takes place after the drum cover is in place. When the drum has been filled with material, the four-way valve is reversed to the up or drum change position and the seal is deflated. The raising of the drum cover is delayed so that the seal is deflated and out of the way when the drum cover is raised. Importantly, the air cylinders should have integral or other speed control means to regulate the rate of raising and lowering the drum cover and the associated actuating rods should have sufficient downward extension to provide a desired amount of slack in the wire cords.

It is therefore a principal object of the present invention to provide a dust control device which filters airborne particulates from air and other gases escaping from a material handling operation which requires no vacuum or other air flow creation means.

Another object is to provide a dust control device having sealing means which expand radially to engage the inside surface of a container.

Another object is to provide a dust control device which is telescopically operable between a raised or "off" position and a lowered or "operating" position.

Another object is to provide a dust control device which engages and provides an airtight seal around the opening of a container without producing compressive forces on the container.

Another object is to provide a dust control device which enables a container to be weighed when engaged therewith.

Another object is to provide a dust control device which is able to compensate for and correct misalignment between the device and a container and which will not damage a misaligned container.

Another object is to provide a dust control device which provides an airtight seal between the device and a container which is out of round or otherwise misshaped.

Another object is to provide a dust control device having filter means which are protected from damage from flowing solids.

Another object is to provide a dust control device having optional fume collection means.

Another object is to provide a dust control device which is relatively simple and inexpensive to manufacture, install and operate and which is adaptable for use with a wide variety of material handling operations and with containers of different sizes and shapes.

These and other objects and advantages of the present invention will become apparent to those skilled in the art after considering the following detailed specification in conjunction with the accompanying drawings wherein:

DETAILED DESCRIPTION OF THE PREFERRED EMBODIMENT

Figure 1:
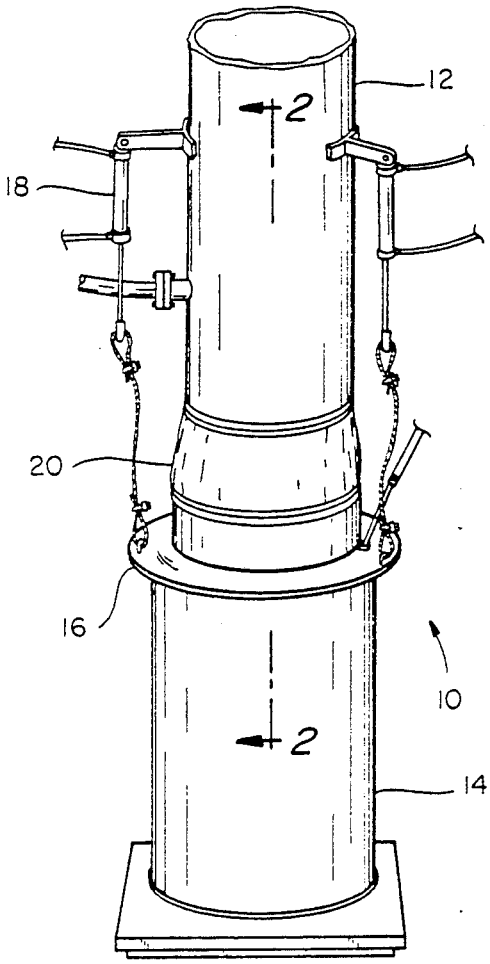
FIG. 1 is a perspective view of the dust control device of the present invention shown in association with a filling chute and a container.

Referring to the drawings more particularly by reference numbers, wherein like numerals refer to like parts, number 10 in FIG. 1 identifies a dust control device constructed according to the teachings of the present invention in association with a fill chute 12 through which material is supplied and a container 14 to be filled with material. Dust control device 10 generally includes a drum cover 16 operable in telescoping relation to chute 12, actuating means 18 which operate to move drum cover 16 upwardly and downwardly and filter sleeve 20 which acts to filter dust from the air which escapes during the filling operation. Dust control device 10 may be permanently or detachably mounted on fill chute 12 using conventional means so as to be supported thereby. Fill chute 12 generally comprises a cylindrical shaped structure constructed of sheet metal or other suitable material having a passage or conduit for the flow of material therethrough. The top end of chute 12 is typically attached to a bulk storage device such as a hopper, silo or bin, or to transfer means such as a screw conveyor or the like, and the bottom end of chute 12 is open. Container 14 is shown as a conventionally shaped drum having an opening at the top thereof. Container 14 may alternatively comprise various other metal, plastic and fiber drums, "LEVERPAK" fiber containers and other conventional and proprietary type containers.

Figure 3:
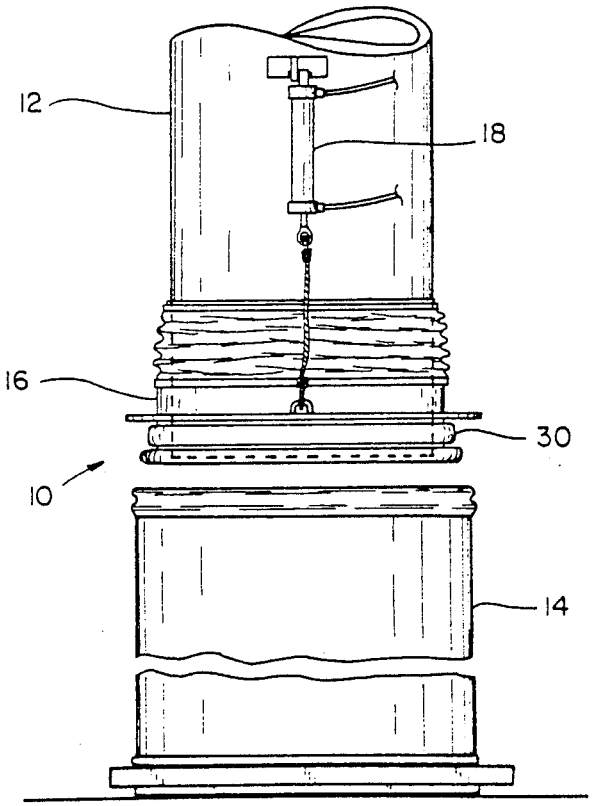
FIG. 3 an enlarged front view of the dust control device of FIG. 1 showing the drum cover in the up position.
Figure 2:
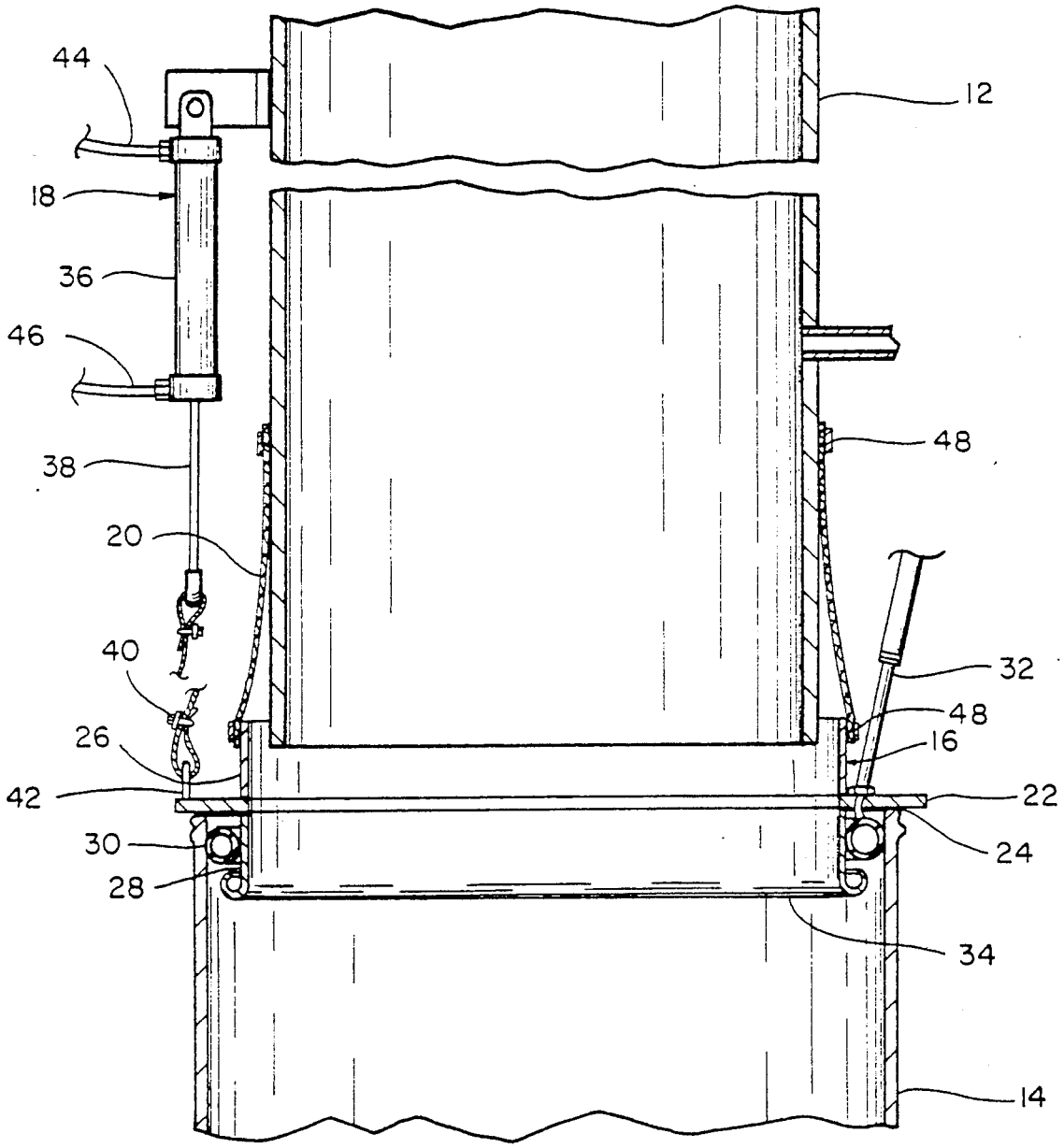
FIG. 2 is an enlarged cross-sectional view of the dust control device of FIG. 1 taken along line 2—2 showing the interior of the device.

Drum cover 16, as best shown in FIG. 2, is a cylindrical shaped structure having a central passage therethrough which forms a conduit for the flow of material into container 14 which may be fabricated from sheet metal or other suitable material. The inside diameter of drum cover 16 should be sufficiently large so as to be locatable in overlaying relation to chute 12 and to be easily operable in telescoping relation therewith and have sufficient clearance or space therebetween for the passage of air which flows and escapes from chute 12 and container 14 during a filling operation. The outside diameter of drum cover 16 should be sufficiently small relative to the size of container 14 to enable drum cover 16 to easily enter the opening of container 14. The relationships of the inside and outside diameter of drum cover 16 with chute 12 and container 14 are important as they enable drum cover 16 to be easily movable between a lowered drum fill or "down" position in engagement with a drum or other container 14 as shown in FIGS. 1 and 2, and a raised drum change or "up" position located above and spacedly related to container 14, as shown in FIG. 3. Drum cover 16 includes an intermediately located circumferential ring or flange 22 around the periphery thereof which flange 22 is adapted to be positionable on the top edge or rim 24 of container 14. When drum cover 16 is in the down position with flange 22 positioned on rim 24 of container 14 an upper portion 26 of drum cover 16 extends upwardly above container 14 and a lower portion 28 extends downwardly into the opening of the container.

Inflatable seal 30 is located in surrounding relation to lower portion 28 of drum cover 14 below flange 22 and is inflatable to form a functionally airtight seal between the outside surface of drum cover 16 and the inside surface of container 14 at a location adjacent to rim 24. Seal 30 is annular shaped and preferably has a generally round or oval cross-sectional shape. When deflated, inflatable seal 30 is smaller in diameter than flange 22 such that seal 30 and lower portion 28 are able to pass easily through the opening of container 14. When inflated, seal 30 expands radially outwardly a sufficient amount to engage the inside wall or inside of rim 24 of container 14, forming an airtight or near airtight seal therearound. Inflatable seal 30 should have such inflatability to also compensate for or correct out-of-round and other common irregularities in container shape. Inflatable seal 30 is inflated and deflated by way of the passage of compressed air through air tube 32, such passage of air being controlled as discussed below.

Lip 34 is located around the lower portion of drum cover 16 below seal 30 and preferably has a rolled or circular shape which extends radially outwardly from the outer surface of drum cover 16 a sufficient amount to prevent deflated seal 30 from contacting the rim 24 or other surfaces of a container 14 when the drum cover 16 is being lowered therein. Lip 34 also functions to guide and maintain alignment of drum cover 16 with the opening of container 14 when the drum cover is lowered into the container. Lip 34 may further act to contain seal 30 when inflated such that the seal is able to exert greater sealing pressure against the inside surface of container 14 and also to keep seal 30 when deflated from snagging and being pulled off of drum cover 16 when the drum cover is raised.

Actuating means 18 include a plurality of pneumatic cylinders 36 which are spacedly related around the periphery of chute 12. Pneumatic cylinders 36 are pivotally attached to arms which extend outwardly from chute 12 and each includes an actuating or control rod 38 which extends downwardly therefrom and is axially operatable upwardly and downwardly relative thereto. Flexible attachment means, preferably comprising a wire cable 40, attach the lowermost end of each rod 38 with a U-bolt 42 located on the top surface of flange 22 to connect actuating means 18 with drum cover 16. The pivotable attachment of cylinders 36 to chute 12 and flexibility of wire cables 40 are important features of the present invention as they enable some degree of freedom of lateral and transverse movement of drum cover 16 suspended therefrom. Such freedom of movement enables drum cover 16 to be guided into the opening of a container 14 when not aligned with chute 12, and provides a self centering capability for drum cover 16. Wire cables 40 also enable rods 38 to fully extend during instances wherein a container 14 is so out of alignment with chute 12 that drum cover 16 does not enter the opening of the container and lip 34 instead engages the top edge or rim 24 without crushing the container or damaging the dust control device. When drum cover 16 is in its down position in proper engagement with container 14, flange 22 is positioned on the top of the container such that the drum cover 16 is supported by the container. Rods 38 extend downwardly a sufficient amount when the drum is lowered such that flexible wire cables 40 are slack when drum cover 16 is positioned on a container 14. This slack in wire cables 40 is important as it enables accurate weighing of containers 14 while the dust control device is engaged therewith as the weight of the components positioned thereon are known and can be easily subtracted from a total weight reading to determine the container weight. Actuating means 18 are controlled by air supplied to each cylinder 36 through upper air lines 44 and lower air line 46, the control of such air supply being discussed in greater detail below.

Filter sleeve 20 acts to trap particulate matter which is airborne in the air or other gases flowing through the annular shaped space between the inside diameter of drum cover 16 and the outside diameter of fill chute 12. Filter sleeve 20 is substantially cylindrical in shape, having a tapered or frusto-conical portion or other shape for reducing the diameter of the top end thereof to enable snug attachment to chute 12. Filter sleeve 20 is preferably fabricated from cloth or other woven flexible and compressible material. The material may be of any suitable composition, for instance "TEFLON" poly tetra fluoro ethylene coated polyester, having interstices sized and shaped so as to be capable of trapping and retaining particles anticipated to be present in a particular application. Importantly, the top end of filter sleeve 20 is attached to fill chute 12 at a location sufficiently above the lower end of fill chute 12 such that filter sleeve 20 is at all times located in surrounding relation to fill chute 12. This location is important because chute 12 is located between filter 20 and the material flowing through chute 12 so that intermediately located chute 12 protects filter sleeve 20 from mechanical and other damage and clogging which may result from contact with flowing materials. The bottom end of filter sleeve 20 is attached to the upper portion of drum cover 16 such that air escaping between chute 12 and cover 16 must pass through filter 20. Attachment of filter sleeve 20 to chute 12 and cover 16 may be made using any conventional means providing a substantially airtight seal, such as band clamp 48. Filter sleeve 20 is adapted to be compressed and compacted when drum cover 16 is in the up position, as shown in FIG. 3, and adapted to be extended when drum cover 16 is in the down position, as shown in FIGS. 1 and 2. When in the extended or down position, filter sleeve 20 preferably provides sufficient surface area for filtering the particulate from the air that escapes between the drum cover 16 and chute 12 during the filling operation.

Figure 4:
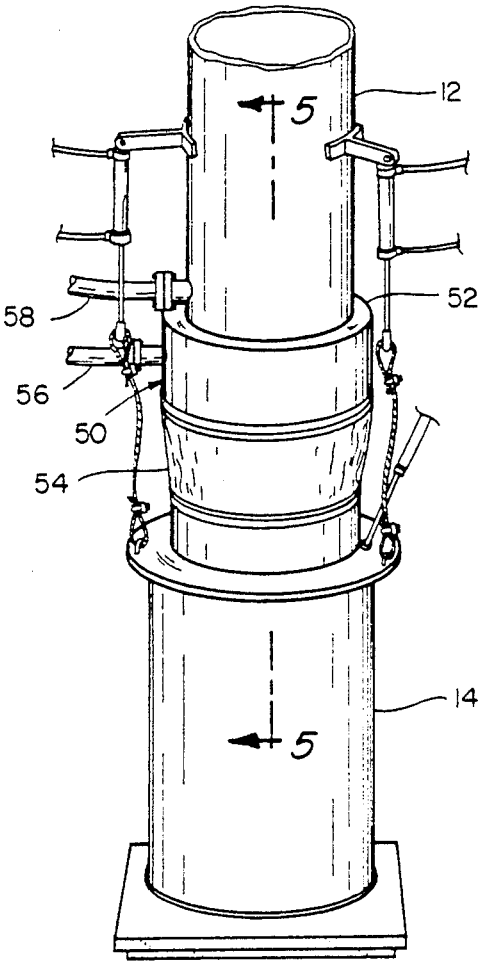
FIG. 4 is a perspective view of the dust control device of FIG. 1 showing an optional fume collection annulus and inlet port.
Figure 5:
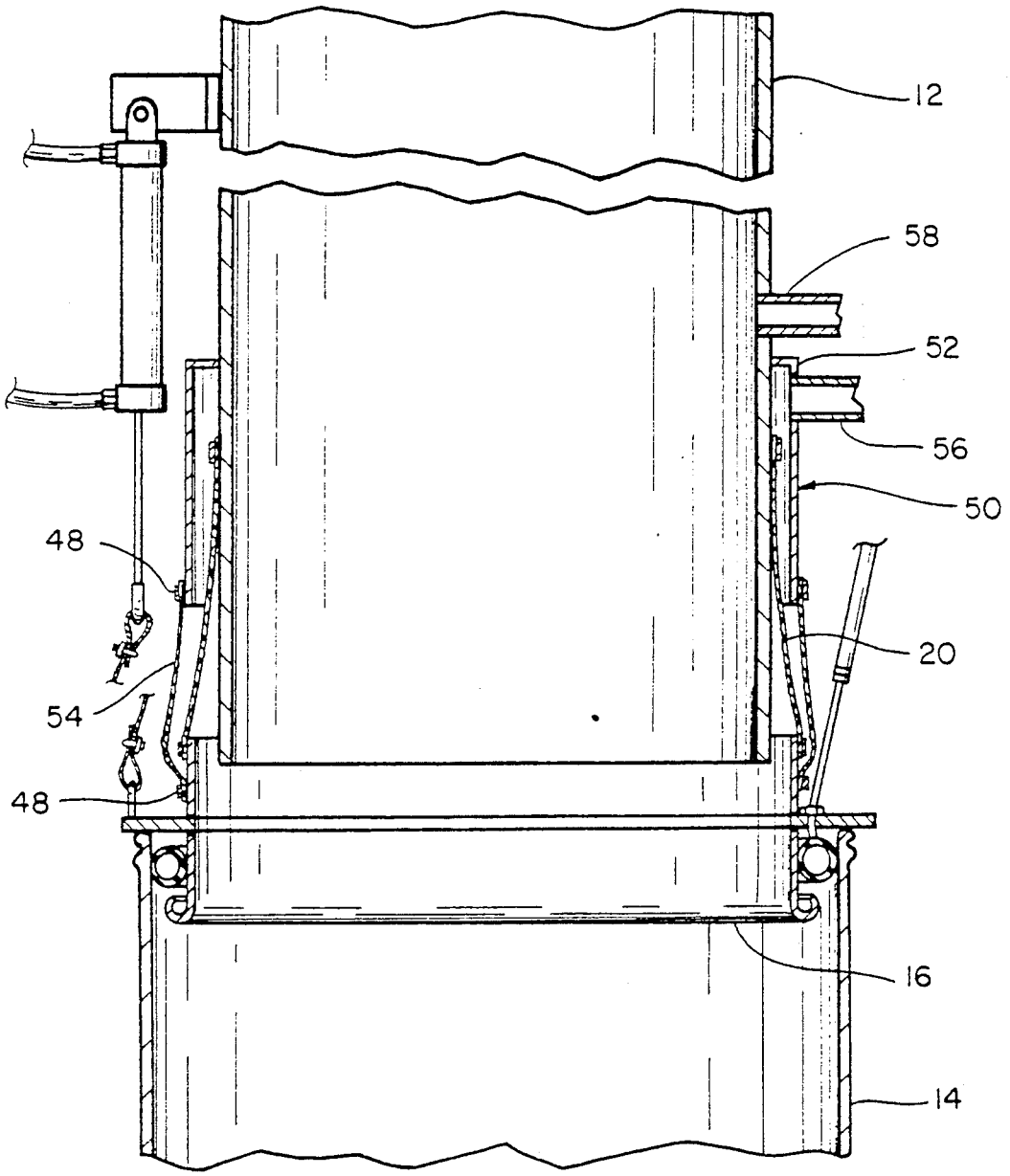
FIG. 5 is an enlarged cross-sectional of the device of FIG. 4 taken along line 5—5 showing the interior of the device and optional fume collection annulus; and, FIG. 6 is a schematic drawing of a control system for the dust control device of claim 1.

Optional fume collection annulus 50 may be used to surround and encompass filter sleeve 20 for collecting toxic, flammable or otherwise dangerous or undesirable gases and fumes which pass through filter sleeve 20, as shown in FIG. 4. Fume collection annulus 50 has a cylindrical shape and preferably includes a rigid hood 52 at the top end and a flexible or expandable boot 54 at the lower end. Hood 52 is preferably of two-piece construction so as to be attachable to chute 12 and dust control device 10 without requiring disassembly of the device 10 from the chute. The upper end of hood 52 is attached to chute 12 at a location above the attachment of filter sleeve 20 forming a closure at the upper end of annulus 50, as best shown in FIG. 5. Hood 52 extends downwardly from the point of attachment and terminates at a point spacedly related to the bottom edge of chute 12. The upper end of boot 54 is attached to the lower end of hood 52 using suitable means such as a band clamp 48 and extends downwardly, the lower end thereof being attached using a clamp 48 to drum cover 16 adjacent the top thereof such that fume collection annulus 50 completely covers and surrounds filter sleeve 20. Flexibility and expandability of boot 54 enables drum cover 16 to be movable between its up and down positions while annulus 50 maintains complete coverage of filter sleeve 20. Boot 54 should be sufficiently large in diameter so as to be spacedly related to the outside surface of filter sleeve 20 when drum cover 16 is in the down position such that vacuum present in the fume collection annulus 50 causes little or no interference between sleeve 20 and boot 54, or obstruction of air flow therebetween. Exhaust port 56 extending through the wall of hood 52 is adapted to remove fumes collected inside fume annulus 50 and such fumes may be carried away and disposed of using vacuum or other suitable means.

Optional inlet port 58, preferably located through the wall of chute 12 above dust collection device 10, as best shown in FIG. 5, may be used for several purposes. For instance, inlet port 58 may be used to introduce inert gas into the interiors of chute 12 and container 14 for purging oxygen and other flammable or toxic gases therefrom, to speed the filling operation, compress the material contained in container 14 and to clear obstructions in the chute 12 and filter sleeve 20.

Figure 6:
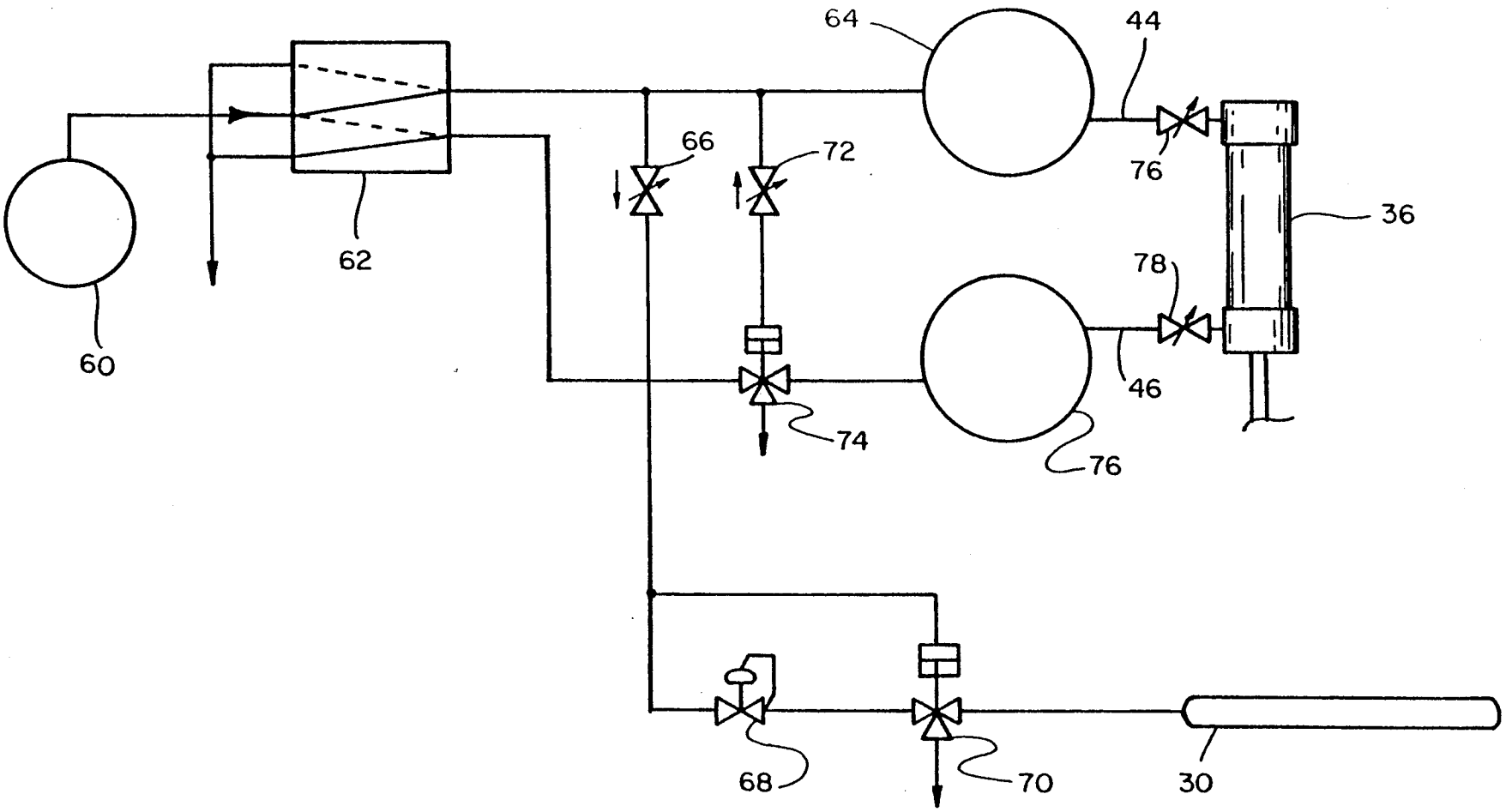

Dust control device 10 is preferably operated by a pneumatic control system, the schematic diagram for which system is shown in FIG. 6. Air supply 60 provides compressed air to a four-way, two-position valve 62 which controls the raising and lowering of drum cover 16 and the inflation and deflation of seal 30. When valve 62 is positioned to lower drum cover 16 to the drum fill position, as shown schematically in FIG. 6, compressed air is supplied directly to upper distribution header 64 and to the restricted flow side of delay valve 66 which restricts the air flow to a pressure regulator 68 and a three-way valve 70 which controls the operation of inflatable seal 30, as discussed below. Distribution header 64 provides simultaneous and equal air pressure to upper air lines 44 which supply air to the top of each air cylinder 36. At the same time, air pressure is supplied to the free flow side of delay valve 72 which operates to open three-way valve 74 to exhaust the air from the bottoms of cylinders 36 by way of lower air lines 46 such that the air cylinders 36 operate to lower drum cover 16 such that flange 22 locates on a container 14 and wire cables 40 slacken. The rate of operation of cylinders 36 may be controlled by integral speed control valves 76 and 78 or external air flow dampening means. After a desired period of delay as determined by the air flow through delay valve 66, valve 70 opens to inflate seal 30. Once seal 30 is inflated, the container filling operation may commence. After container 14 has been filled as desired, valve 62 is moved to the drum change position, shown in FIG. 6 in dashed lines, and valve 70 is immediately operated by the release of air pressure through the free flow side of valve 66 to deflate seal 30 and air pressure is immediately released from the top of cylinders 36. After a delay by valve 72, valve 74 opens to supply air to lower distribution header 76 which in turn provides air simultaneously and equally through lower air lines 46 to the lower portion of air cylinders 36, with the air pressure to the tops of cylinders 36 previously released to raise drum cover 16.

Flexible attachment means 40, while preferably comprising wire cable, may alternatively comprise rope or cord made from polymeric material such as nylon or polyester, or made from natural fibers, or any other suitable material, as desired. Inflatable seal 30 may be made from any elastomeric material capable of repeated inflation and deflation. Such polymeric materials include compounded natural rubber and synthetic rubbers such as polyisoprene, styrene-butadiene rubber, and other rubbery materials. Also, plastic compositions such as polyamides, acrylonitrile copolymers, polyolefins such as polypropylene, and polyesters may be used to make inflatable seal 30. The inflatable seal 30 may have any cross-sectional shape such as rectangular, U-shape and the like, but will generally be of circular or oval cross-section.

The composition of filter sleeve 20 may vary somewhat depending on the product being packaged. It is necessary that such materials be capable of repeated compaction and extension. Also, the interstices in the material of the filter sleeve should be uniform and capable of trapping particles to be encountered in a particular packaging application. A "TEFLON" poly tetra fluoro ethylene coated polyester material, referred to above, marketed by J.W. Thompson Co. may be particularly useful. Other useful materials include fabrics made from acrylic fibers, cotton-dacron blends, nylon 66, nylon 6 and wool.

Boot 54 should be also capable of repeated compression and extension without cracking and must always remain capable of containing any gases eminating from the filling operation. A particularly useful boot material may be a vinyl composition reinforced with nylon threads which is marketed by Filtration System Products Company. Other compositions which may be used to make the boot include polyamide compositions, vinyl resins reinforced with polyesters, polyester compositions and may include cloth which may be cotton, wool or other fabric materials impregnated with a plastic coating capable of containing and preventing any gases from passing therethrough.

Although the invention has been described as utilizing pneumatic cylinders as actuating means 18, any other suitable means may be used for raising or lowering dust control device 10, such as hydraulic systems, electric servos and solenoids, a manual controlled lever or other means utilizing mechanical advantages. Also, the entire process for filling containers with the dust control device of this invention may be completely automated with state-of-the-art devices, for instance, utilizing sensors in hydraulic systems whereby containers would be moved into position for filling on an assembly line basis after which the dust control device of this invention would be actuated during the container filling. A sensing device could be included to sense when the container is filled which could in turn activate the assembly line to move another container into position for filling. Even the covers could be attached to the filled containers by means of robotic arms or other automated means. Also, numerous known vacuum assist systems could be used to increase the filling rate of the containers.

Thus there has been shown and described novel means for dust control apparatus. The present invention fulfills all the objects and advantages set forth above. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention, which is limited only the claims which follow.

We claim:

1. A dust control apparatus comprising:

a cover member adapted to be lowered into a position inside an opening of a container, said cover member having sealing means adapted to expand radially to provide a substantially airtight seal between said cover member and the container, said cover member having a passage therethrough, said cover member being locatable in surrounding relation to a material handling conduit located in said passage and operable in telescoping relation thereto so as to be lowerable into position in a container, said passage being sufficiently larger than a material handling conduit located therein so as to have a space therebetween for the passage of air between said cover member and the conduit, said cover member being movable laterally relative to the conduit so as to enable said cover member to be lowered into a container which is not precisely aligned therewith, a filter sleeve having a lower end attached to said cover member and an upper end attached to the material handling conduit, said filter sleeve being adapted to prevent the escape of dust from the space between said cover member and the conduit and adapted to be expandable as said cover member is lowered into a container and compactible as said cover member is removed therefrom.

2. The apparatus of claim 1 wherein said filter sleeve is located in surrounding relation to the material handling conduit such that the conduit protects said filter sleeve from damage from material flowing through the conduit.

3. The apparatus according to claim 1 wherein said filter sleeve is fabricated from a porous filter cloth or other suitable porous material adapted for the passage of air therethrough but adapted to preclude the passage of certain size particulate matter therethrough.

4. The apparatus according to claim 1 wherein said filter sleeve is comprised of a fabric selected from the group consisting of "TEFLON" poly tetra fluoro ethylene coated polyester, acrylic fibers, cotton-dacron blends, nylon 66, nylon and wool.

5. The apparatus claim 1 wherein said cover member includes a flange adapted for engaging the top of a container when said cover member is positioned inside the opening thereof such that said cover member may be supported by the container when so engaged.

6. The apparatus of according to claim 1 wherein said cover member has a circumferential lip extending radially outwardly therefrom located below said sealing means for protecting said sealing means and guiding said cover member as it is lowered into the opening of a container.

7. The apparatus according to claim 1 wherein actuating means are provided for raising and lowering said cover member.

8. The apparatus according to claim 7 wherein said actuating means include a plurality of pneumatic cylinders for raising and lowering said cover member.

9. The apparatus according to claim 7 wherein said actuating means include flexible means enabling said cover member to move laterally and to engage a misaligned container without damaging the apparatus or container.

10. The apparatus according to claim 1 wherein said sealing means comprising an inflatable seal adapted for expansion and contraction located circumferentially around said cover member.

11. The apparatus of claim 10 wherein said inflatable seal is comprised of a rubbery material.

12. The apparatus according to claim 11 wherein said rubbery material is selected from the group consisting of natural rubber, polyisoprene, styrene-butadiene rubbers, polyamids, acrylonitrile copolymers, polyolefins and polyesters.

13. The apparatus according to claim 1 wherein fume collection means surround said filter sleeve and are adapted to collect for discharge certain materials which may pass through said filter sleeve.

14. The apparatus according to claim 13 wherein said fume collection means comprise a rigid hood and a flexible boot, said boot being comprised of a non-porous plastic material.

15. The apparatus according to claim 13 wherein said fume collection means have exhaust means for evacuating the materials collected thereby.

16. The apparatus according to claim 1 having means for purging said apparatus, container and conduit with an inert gas to eliminate any combustible gases, toxic fumes or other unwanted gaseous materials therefrom.

17. A dust control apparatus comprising;

a drum cover having a lower portion adapted to be positioned in the opening of a container to be filled with material, said drum cover having radially expandable sealing means located in surrounding relation to a portion of said lower portion, aid sealing means being adapted to expand so as to form a substantially airtight seal between said drum cover and container, said drum cover having a center passage therethrough, said center passage being adapted to receive a fill chute adapted to convey material into a container, said passage being somewhat larger than the fill chute so as to define a space therebetween, said drum cover being operable in telescoping relationship with the fill chute between a position removed from a container and a position in the opening of a container, said drum cover having a substantial degree of freedom of lateral movement in said space between said drum cover and the chute so as to enable said drum cover to be maneuverable into an opening of a container which is not aligned therewith, a filter sleeve having a lower end attached to said drum cover and an upper end attached to the fill chute, said filter sleeve being adapted to prevent the escape of dust through said space between said drum cover and the fill chute, said filter sleeve being adapted to be compactible as said drum cover is removed from a container.

18. The dust control apparatus of claim 17 further comprising actuating means for telescopically operating said drum cover relative to a fill chute, said actuating means having an upper end pivotally attached to the fill chute and a lower end attached to said drum cover with flexible means enabling said drum cover to be laterally movable such that said lower end is positionable in the opening of a container which is not precisely aligned and centered with said drum cover and enabling said drum cover to engage the top of a severly misaligned container without damaging the apparatus or container.

19. The dust control apparatus of claim 17 wherein said drum cover further comprises a flange located intermediately between said upper and lower ends, said flange extending around the circumference of said drum cover and extending radially outwardly therefrom, said flange being engageable with a top edge of a container when said drum cover lower portion is located in the container opening such that said drum cover may be supported by the container.

20. A dust control apparatus comprising;

a drum cover having an upper end, a lower end opposite said upper end and a central passage extending through said upper and lower ends, said drum cover being positionable in surrounding relation to a fill chute located in said central passage, said drum cover being sufficiently larger than the fill chute such that a space remains therebetween, said drum cover being operable in telescoping relation to the fill chute so as to be lowerable into engagement with a container located thereunder such that said lower end is positioned in an opening in the top of the container and said upper end extends upwardly therefrom, sealing means having an annular shape located in surrounding relation to the outer periphery of a portion of said drum cover lower end, said sealing means being radially expandable to form a substantially airtight seal around the container adjacent to the opening thereof when said lower end is positioned therein, and, an annular shaped filter sleeve having an upper end attached to the fill chute and a lower end attached to said drum cover upper end so as to be in covering relation to the space between said drum cover and the chute, said filter sleeve having a plurality of interstices therein which allow air to pass therethrough but prevent the passage of particulate matter, said filter sleeve being extendable when said drum cover is engaged with a container and compactible when said drum cover is disengaged from a container.

* * * * *